United States Patent [19]

Ikenishi et al.

[11] 4,204,395

[45] May 27, 1980

[54] CALENDAR MECHANISM OF A PORTABLE TIMEPIECE

[75] Inventors: Masataka Ikenishi; Joichi Miyazaki; Shozo Kushida; Hiromasa Nakanishi, all of Tokyo, Japan

[73] Assignee: Kabushiki Kaisha Daini Seikosha, Japan

[21] Appl. No.: 906,561

[22] Filed: May 16, 1978

[30] Foreign Application Priority Data

May 20, 1977 [JP] Japan ..... 52/58382

[51] Int. Cl.[2] ..... G04B 19/24; G04B 33/00

[52] U.S. Cl. ..... 368/35; 368/221

[58] Field of Search ..... 58/4 R, 4 A, 34, 57, 58/58, 63, 85.5, 126 R, 126 A, 138

[56] References Cited

U.S. PATENT DOCUMENTS

| | | | |
|---|---|---|---|
| 3,659,412 | 5/1972 | Miyasaka et al. | 58/4 R |
| 3,765,162 | 10/1973 | Ushiyama et al. | 58/4 R X |
| 3,819,929 | 4/1975 | Charbonnet et al. | 58/5 |
| 3,916,614 | 11/1975 | Takatsuki | 58/59 |
| 3,939,645 | 2/1976 | Charbonnet | 58/58 X |

FOREIGN PATENT DOCUMENTS

| | | | |
|---|---|---|---|
| 1023415 | 1/1958 | Fed. Rep. of Germany | 58/58 |

*Primary Examiner*—Vit W. Miska

*Attorney, Agent, or Firm*—Robert E. Burns; Emmanuel J. Lobato; Bruce L. Adams

[57] ABSTRACT

A calender mechanism comprising a cannon wheel having a gear wheel portion and a cylindrical portion extending axially from the gear wheel portion, a day star wheel mounted for rotation on a cylindrical portion of the cannon wheel, and a positioning plate. The day star wheel has an outer diameter less than that of the gear wheel portion of the cannon wheel, and the positioning plate is positioned to partially overlie the outer peripheral portion of the gear wheel portion for preventing the cannon wheel from traveling axially toward the day star wheel. The portion of the positioning plate overlying the outer peripheral portion of the cannon wheel does not extend between the day star wheel and the gear wheel portion of the cannon wheel.

8 Claims, 6 Drawing Figures

CALENDAR MECHANISM OF A PORTABLE TIMEPIECE

BACKGROUND OF THE INVENTION

The present invention relates to the construction of the portable timepiece with a calendar mechanism which is of use as a means for making a thickness of the portable timepiece thinner.

Generally, in a conventional portable timepiece having a calendar mechanism, a cannon wheel has a cannon cylindrical portion on which a day star wheel is rotatably disposed in the internal peripheral portion of a date wheel, and the date wheel and the cannon wheel are restrained from axial direction movement by means of a positioning plate disposed over the date wheel and the cannon wheel. In this case, the internal portion of the positioning plate 2 of the conventional portable timepiece is disposed between the cannon wheel 1 and the day star wheel 3 the diameter of which is larger than that of the cannon wheel, and the peripheral portion of the positioning plate 2 is disposed adjacent to the inner peripheral wall of the data dial 4 as shown in FIG. 1. Accordingly, as, in the conventional portable timepiece, the positioning plate 2 is disposed between the day star wheel 3 and the cannon wheel 1, the height "$h_1$" from the upper surface of a pillar plate 6 to that of a day calendar dial 5 is very large. As the result, this causes the axial length of the portable timepiece to increase and prevents the thickness of the portable watch from being made thinner.

SUMMARY OF THE INVENTION

The present invention improves the construction of the conventional portable timepiece.

The main object is to provide a portable timepiece the thickness of which is thinner than that of the conventional timepiece.

In the portable timepiece of the present invention, the diameter of a day star wheel is made smaller than that of the cannon wheel and a positioning plate is disposed around the day star wheel, instead of on top of or below the day star wheel, to thereby prevent the day star wheel from being stacked with the positioning plate. Accordingly, the location of the positioning plate and the day star wheel prevent the thickness of the timepiece from increasing.

DESCRIPTION OF THE PREFERRED EMBODIMENT

Referring now to one of the embodiments of the present invention shown in the accompanying drawings, the present invention is described in detail hereinafter.

Figure 1:
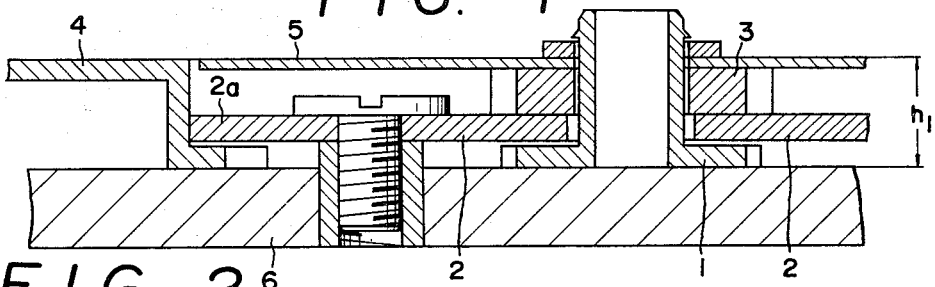
FIG. 1 is a longitudinal sectional view showing partially the construction of a conventional timepiece.
Figure 2:
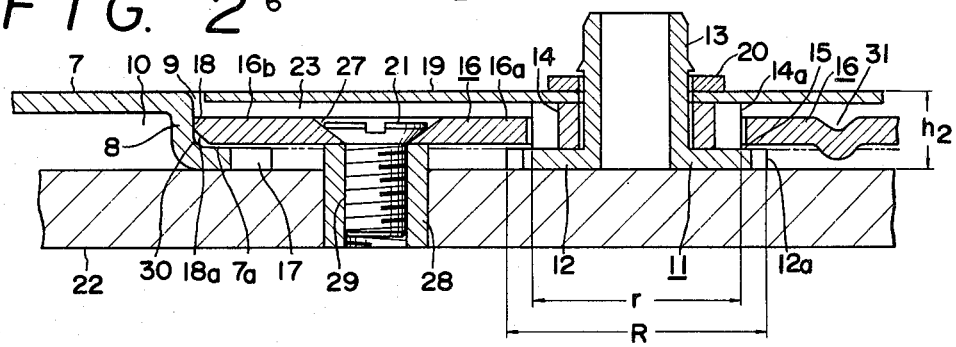
FIG. 2 is a longitudinal section view showing partially the construction of the calendar mechanism according to the present invention.

In FIG. 2, the date dial 7 is provided with a step portion 8 at the inner peripheral portion thereof. Spaces 9 and 10 are defined by the data dial 7, the step portion 8, the day calendar dial 19 and the pillar plate 22. A gear portion 12 of a cannon pinion 11 is rotatably disposed in the space 9 and the cannon pinion 11 comprises a cylindrical portion 13 around which the day star wheel 7 is rotatably disposed and a gear portion 12. The day star wheel 14 which is located on the upper surface of the gear portion 12 of the cannon pinion 11 has the diameter r which is smaller than the diameter R of the gear portion 12 of the cannon pinion 11 whereby the tip portion **12*a* of the cannon pinion 11 is projected from the power portion of the peripheral portion 14*a* of the day star wheel 14 in the radial direction thereof. A positioning plate 16 for positioning the cannon pinion 11 is disposed over the upper surface of the gear portion 12 around the peripheral portion of the day star wheel 14**.

The positioning plate 16, the lower surface of which is substantially even with that of the day star wheel 14 and the internal portion **16*a* of which is disposed over the peripheral portion of the gear portion 12 prevents the cannon wheel 11** from moving vertically.

The peripheral portion 16b of the positioning plate 16 which is extended from the tip portion **14*a* of the day star wheel 14 to the step portion 8 of the data dial 7 covers the internal peripheral portion 7*a*, and the projections 18 of the positioning plate which are provided at proper intervals around the peripheral side portion of the positioning plate 16 are disposed against the inner side wall of the step portion 8 to thereby prevent the date dial 7** from moving vertically.

It will be noted that all of the peripheral portion **16*b* of the positioning plate 16 may be disposed over the internal peripheral portion 7*a* and position the date dial 7 or only a part of the peripheral portion 16*b*** may do it.

As mentioned above, the positioning plate 16 positions not only the gear portion 12 of the cannon wheel 11 but also the internal periperal portion **7*a***.

A numeral 19 disignates a day calendar dial which is fixed on the day star wheel 14 and is rotated with it. A numeral 20 designates a ring which fixes the day calendar dial 19 to the day star wheel 14.

The positioning plate 16 which is fixed on a pillar plate or support plate 22 by means of set screws 21 properly positions the gear portion 12 of the cannon wheel 11 and the internal peripheral portion **7*a* of the date dial 7 on the pillar plate 22**.

As mentioned above, the day star wheel 14 is disposed around the cylindrical portion 13 of the cannon wheel 11 and the day star wheel 14 and the positioning plate 16 are disposed at the level of the upper surface of the gear portion 12 of the cannon wheel 11.

Accordingly, the axial distance between the pillar plate 22 and the day star wheel 14 is shorter than that of the conventional timepiece, so that the height $h_2$ between the day calendar dial 19 and the pillar plate 22 is smaller than that of the conventional calendar timepiece. This permits the total thickness of the portable timepiece to be reduced more than that of the conventional timepiece.

Accordingly, the space 23 defined by the day calendar dail 19 and the positioning plate 16 is very smal in the axial direction of the pillar plate 22 so that the head of the set screw 21 should not project from the upper surface of the positioning plate 16. The head of the set screw 21 which is shaped like a truncated cone is fitted into the opening 27 of the positioning plate 16 so as not to project from the upper surface of the positioning plate 16.

Accordingly, the head of the set screw 21 is not in contact with the day calendar dial 19 to thereby permit the day calandar dial 19 to be smoothly rotated over the upper surface of the positioning plate 16.

Figure 3:
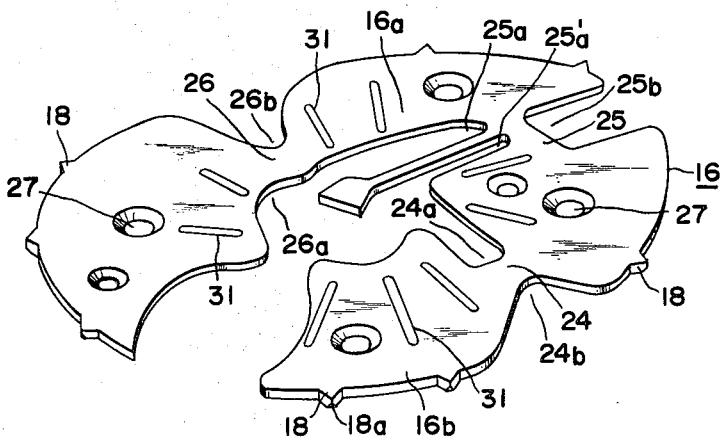
FIG. 3 is a perspective view of the positioning plate embodying the present invention.

As shown in FIG. 3, the positioning plate 16 is provided on the internal portion 16*a* and the peripheral portion 16*b* thereby with a plurality of grooves or notches 24*a*, 24*b*, 25*a*, 25'*a*, 25*b*, 26*a* and 26*b*.

A first, a second and a third reduced or narrow portion 24, 25 and 26 are provided on the positioning plate 16 between the first and the second notches 24*a* and 24*b*, the first, the second and the third grooves 25*a*, 25'*a* and 25*b*, and the first and the second V-shaped portion 26*a* and 26*b*, respectively. The positioning plate 16 is provided with openings 27 into which the heads of set screws 21 are disposed without the head projecting from the surface of the positioning plate 16. The pillar plate 22 is provided with hollow pins 28 which have female screws 29 on the inner surface thereof.

The positioning plate 16 is fixed on the upper portion of the hollow pins 28 by means of the set screws 21 which are screwed into the female screws 29 through the openings 27 the center axes of which are in coincidence with that of the hollow pins 28 whereby the positioning plate 16 is fixed on the pillar plate 22 by the hollow pins 28 and the set screws 21. In this state, as if the center axes of the openings 27 of the positioning plate 16 are not in coincidence with those of a female screws 29 because of the machining error, the positioning plate 16 still is precisely located on the upper portion of the hollow pins 28 by means of the set screws 21 because the deflection of the positioning plate 16 which is caused by the incoincidence of the center axes of the openings 27 and those of the holow pins 28 are only absorbed at the first to the second reduced portions 24 to 26. For example, if the center axes of the female screws are not aligned with that of the opening 27 in the direction of the internal portion 16*a*, the positioning plate 16 is forcedly bent in the direction of the center portion of the pillar plate 22 when the set screws 21 are fixedly threaded into the female screws 29. The positioning plate 16 is not, however, deflected in the axial direction of the pillar plate 22 by the bend of the positioning plate 16 as mentioned above because the positioning plate 22 is only horizontally deflected at the first to the third reduced portions 24 to 26. As a result, it is not necessary that a big space be defined by the day calendar dial 19 and the positioning plate 16. This allows the portable timepiece to be made very thin.

The data dial 7 is provided with the step portion 8 along the inner peripheral portion thereof as mentioned above. The step portion 8 is formed by means of a press machine whereby a curved corner 30 is naturally formed. On the other hand, the peripheral portion 16*b* of the positioning plate 16 is disposed in parallel with the internal peripheral portion 7*a* of the date dial 7 and the projections 18 provided on the peripheral portion 16*b* of the positioning plate 16 are in contact with the internal peripheral surface of the step portion 8.

The projections 18 are provided with the relief angle surface 18*a* to avoid bringing the projections 18 into contact with the curved corner 30. Accordingly, the positioning plate 16 can be disposed adjacent the internal peripheral portion 7*a* of the date dial 7 to thereby make the total thickness of the portable timepiece thinner.

The positioning plate 16 is provided with a plurality of depressions 31 which are formed like oval shaped grooves, respectively whereby the bending strength of the positioning plate 16 increases.

This structure of the positioning plate 16 has a merit as follows: For example, when an hour hand (not shown in figure) is removed from the cylindrical portion 13 of the cannon wheel 11, the positioning plate 16 is upwardly pressed by the gear portion 12. The positioning plate 16, however, is not easily bent then, since a plurality of the depressions 31 are provided on the positioning plate 16. Accordingly, the cannon wheel 11 is positioned by the positioning plate 16 without moving in the axial direction of the cannon wheel 11 to thereby prevent the cannon wheel from being disengaged with an other wheel (not shown in figures).

It will be noted that it is not necessary that the shape of the depressions 31 is restricted to the shape as mentioned above and also the depressions 13 can be placed in other position on the positioning plate 16 except the internal portion 16*a* of the positioning plate 16.

Figure 4:
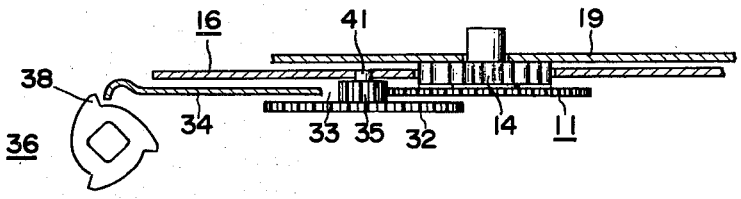
FIG. 4 and FIG. 5 are longitudinal sectional views to show the relation between the positioning plate and a data correcting lever, respectively.
Figure 6:
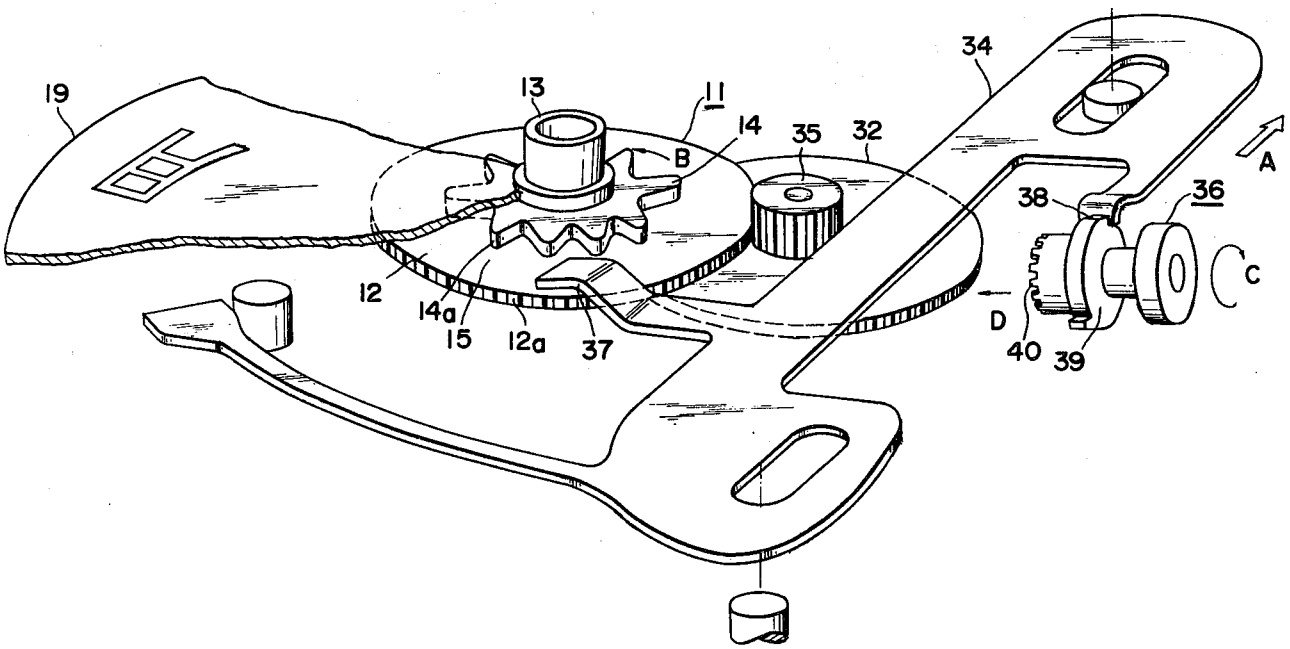
FIG. 6 is a perspective view to show the relative position between the cannon wheel and the date correcting lever.

In FIG. 4, the positioning plate 16 is disposed over the gear portion 12 of the cannon wheel 11 and a date correcting lever 34 is disposed in the space defined by the positioning plate 16 and a minute wheel 32. The minute wheel 32 is provided on the upper surface thereof with a minute wheel pinion 35 which is in engagement with the cannon wheel 11. A numeral 36 designates a clutch wheel. When the clutch wheel 36 is rotated in the direction of the arrow C, a cam which is provided on the peripheral portion of the clutch wheel 36 is engaged with the date correcting lever 34 whereby the date correcting lever 34 slides in the direction of the arrow A as shown in FIG. 6. By the sliding movement of the date correcitng lever 34, the date finger 37 extending from the date correcting lever 34 to the day star wheel 14 slides in the direction of the arrow A to thereby be engaged with the tip portion 14*a* of the day star wheel 14 and rotate the day star wheel 14 in the direction of the arrow B as shown in FIG. 6. By the rotation of the day star wheel 14, the day calendar dial 5 is rotated in the direction of the arrow B.

According to the structure of the present invention, the spaced defined by the positioning plate 16 and the minute wheel 32 is available for making the thickness of the portable timepiece thinner. Namely, the day star wheel of the conventional timepiece is disposed over the positioning plate and also the date correcting lever is stacked and disposed over the positioning plate to thereby make the thickness of the conventional timepiece thicker than if the present invention is incorporated in a timepiece.

The day star wheel of the present invention is disposed at a lower position than that of the conventional timepiece and also the date correcting lever 34 is disposed at a lower position. Accordingly, this is effective for making the timepiece thinner. The positioning plate 16 disposed at the upper portion of the date correcting lever 34 positions the date correcting lever 34 to thereby prevent it from rising from the proper position thereof. It will be noted that a numeral 41 designates a bearing provided on the positioning plate 16.

Figure 5:
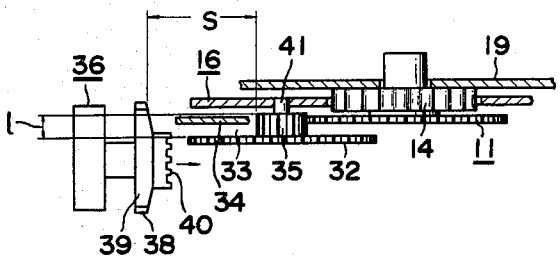

Referring to FIG. 5, when a winding stem (not shown in figures) is pulled out and positioned at the third stage, the clutch wheel 36 is shifted in the direction of the arrow D and the crown gear teeth 40 of the clutch wheel 36 are engaged with the minute wheel 32. When the clutch wheel 34 is rotated by the rotation of the winding stem, the minute wheel 32 which is in engagement with the clutch wheel 36 is rotated. Accordingly, the cannon wheel 11 which is in engagement with the minute wheel pinion 35 is rotated whereby an hour hand (not shown) is rotated to thereby be capable of adjusting the position of the hour hand. As mentioned above, the clutch wheel 36 is directly in engagement with the minute wheel 32 and it is not necessary that a setting wheel (not shown) be disposed between the crown gear teeth 40 and the minute wheel 32, so that the distance S between the cam plate 39 and the minute wheel pinion is longer than that of conventional timepieces. As the result, the date correcting lever 34 can be disposed in the space defined by the minute wheel 32 and the positioning plate 16 which is in parallel with the minute wheel 32. Utilizing the space as mentioned above permits the thickness of the portable timepiece to be made thinner.

It will be noted that the positioning plate of the present invention may be fixed to an other fixed member in the timepiece.

As mentioned above, the present invention provides the portable timepiece the thickenss of which is thinner than that of the conventional timepiece. Namely, the diameter of the day star wheel is made smaller than that of the gear portion of the cannon wheel, and the positioning plate is disposed around the day star wheel with positioning the cannon wheel, and the day star wheel and the positioning plate is disposed so that the lower surfaces of them are nearly disposed on a level with the upper surface of the gear portion of the cannon wheel.

Accordingly, not only the day star wheel but also the day calendar dial, the date correcting lever and etc. are disposed closer to the pillar plate than those of the conventional timepiece. As a result, it is possible to provide a portable timepiece the thickness of which is thinner than that of the conventional timepiece.

What is claimed is:

1. A calendar mechanism for a portable timepiece, comprising: a cannon wheel having a gear wheel portion and a cylindrical portion extending from said gear wheel portion axially thereof; a day star wheel mounted for rotation on the cylindrical portion of said cannon wheel and positioned coaxial with and adjacent the gear wheel portion of said cannon wheel, and said day star wheel having an outer diameter less than an outer diameter of said gear wheel portion of said cannon wheel, wherein an outer peripheral portion of the gear wheel portion of said cannon wheel extends beyond said day star wheel; and a positioning plate comprised of a plate-like member positioned to partially overlie the outer peripheral portion of the gear wheel portion of said cannon wheel and adjacent said outer peripheral portion for preventing said cannon wheel from traveling axially toward said day star wheel, and the portion of said positioning plate overlying said outer peripheral portion of said cannon wheel having a periphery which clears said day star wheel with no part of said positioning plate interposed between said day star wheel and the gear wheel portion of said cannon wheel.

2. A calendar mechanism according to claim 1, further comprising: an annular date dial positioned surrounding said cannon wheel and said day star wheel and having an inner peripheral portion; and wherein said positioning plate is adjacent to and overlies at least a portion of the inner peripheral portion of said date dial for preventing said date dial from traveling in the direction of said positioning plate.

3. A calendar mechanism according to claim 2, wherein said date dial includes a step portion adjacent the inner peripheral portion thereof, and wherein the portion of said positioning plate which overlies the inner peripheral portion of said date dial is adjacent the step portion of said data dial for preventing displacement of said date dial along directions of the surface of said positioning plate.

4. A calendar mechanism according to claim 2, wherein the step portion of said date dial and the inner peripheral portion of said date dial merge to form a curved annular corner, and wherein said portion of said positioning plate which overlies the inner peripheral portion of said date dial and which is adjacent the step portion of said date dial is beveled to provide clearance for said curved annular corner.

5. A calendar mechanism according to claim 1 or 2, further comprising: a support plate for supporting thereon said cannon wheel and said positioning plate; said support plate having holes therein and said positioning plate having holes therethrough aligned with the holes in said support plate; fastening means passing through the respective holes through said positioning plate and into the corresponding holes in said support plate for fastening said positioning plate to said support plate; and wherein said positioning plate includes narrow portions sufficiently narrow to permit deformation of said positioning plate at said narrow portions substantially completely transversely of said positioning plate to compensate for misalignment of the holes through said positioning plate and the holes in said support plate without deforming said positioning plate in a direction toward or away from said support plate.

6. A calendar mechanism according to claim 1 or 2, wherein said positioning plate has depressed portions effective to strengthen said positioning plate to resist bending.

7. A calendar mechanism according to claim 2 further comprising: a minute wheel engaging the gear portion of said cannon wheel; and a date correcting lever positioned between said positioning plate and said minute wheel for engaging said date dial to correct the date.

8. A calendar mechanism according to claim 7, wherein said date correcting lever is adjacent said positioning plate, and said positioning plate is effective to position said date correcting lever and prevent said date correcting lever from traveling in the direction of said positioning plate.

* * * * *